United States Patent [19]

Rogers et al.

[11] 4,391,194

[45] Jul. 5, 1983

[54] METHOD FOR ADDRESSING CARDS AND ENVELOPES

[75] Inventors: Ronald A. Rogers, Apple Valley; Ansel J. Wright, Minneapolis; William H. Wright, Hopkins, all of Minn.

[73] Assignee: Master Addresser Company, Minneapolis, Minn.

[21] Appl. No.: 259,181

[22] Filed: Apr. 30, 1981

Related U.S. Application Data

[60] Continuation of Ser. No. 97,377, Nov. 21, 1979, abandoned, which is a division of Ser. No. 854,611, Nov. 25, 1977, Pat. No. 4,186,659.

[51] Int. Cl.[3] ..... B41M 5/00

[52] U.S. Cl. ..... 101/471

[58] Field of Search ..... 101/468, 469, 470, 467, 101/47, 52, 53, 57, 58, 131, 131.5, 422, 132, 56, 337

[56] References Cited

U.S. PATENT DOCUMENTS 3,751,318 8/1973 Newman ..... 156/234

FOREIGN PATENT DOCUMENTS 1195131 6/1970 United Kingdom .

*Primary Examiner*—Edward M. Coven

*Attorney, Agent, or Firm*—Merchant, Gould, Smith, Edell, Welter & Schmidt

[57] ABSTRACT

A method for printing addresses on envelopes or cards from a plurality of master cards each having an address and other indicia imprinted thereon with heat conducting material, such as carbon. Master cards and envelopes or cards to be printed are delivered to a printing zone in face-to-face relationship together with a length of printing tape interposed between each master card and its respective envelope or card to be printed. The tape has one surface coated with heat-transferable printing medium disposed in face-to-face relationship with the envelopes. The master cards, tape and envelopes or cards to be printed are pressed together at the printing zone where heat is applied to the heat conducting indicia on the master cards.

18 Claims, 22 Drawing Figures

METHOD FOR ADDRESSING CARDS AND ENVELOPES

This is a continuation of application Ser. No. 097,377, filed Nov. 21, 1979, now abandoned which is a divisional application of Ser. No. 854,611, filed Nov. 25, 1977, issued as U.S. Pat. No. 4,186,659 on Feb. 5, 1980.

BACKGROUND OF THE INVENTION

This invention relates generally to duplicating apparatus and more particularly to the addressing of cards and envelopes for mailing. This invention involves a method of addressing cards and envelopes with the aid of master cards having indicia imprinted thereon that does not become weakened by repeated use, as is the case with master cards or sheets used in spirit duplicating systems and hectographic systems commonly employed. An important object of this invention is the provision of an addressing or duplicating machine that eliminates the use of volatile liquids in the printing process and deterioration of printing indica on master elements.

SUMMARY OF THE INVENTION

The machine of this invention involves a heating element; means for feeding a master element, having indicia of heat conducting material imprinted thereon, in close proximity to the heating element; means for feeding a print receiving member in close proximity to the heating element outwardly of said master element relative to the heating element, in the same direction as said master element. Further, means is provided for intermittently feeding a predetermined length of heat-transferable printing medium equipped flexible sheet material between said master element and said print receiving member and past said heating element with said master element and print receiving member. Further, pressure means is provided for pressing said print receiving member, sheet material and master element together adjacent said heating element during feeding movement of the print receiving member; sheet material and master element.

DETAILED DESCRIPTION OF THE PREFERRED EMBODIMENT

Figure 14:
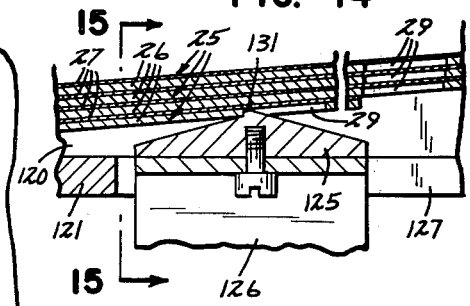
FIG. 14 is a still further enlarged fragmentary section taken on the line 14—14 of FIG. 13.
Figure 15:
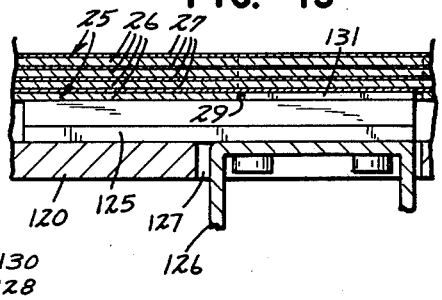
FIG. 15 is a fragmentary section taken on the line 15—15 of FIG. 14.
Figure 21:
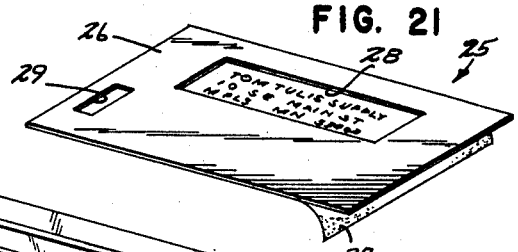
FIG. 21 is a view in perspective of a master card used in connection with this invention.

In the duplicating or printing of given indicia on a mailing card or envelope, or any other sheet-like member to be printed, a master element in the nature of a card having the indicia imprinted thereon is used. The machine of the present invention is adapted to utilize a plurality of master cards of the type shown in FIG. 21 and fragmentarily in FIGS. 14 and 15, the card being indicated generally at 25. Each master card 25 includes a relatively thicker support layer 26 of lightweight cardboard, and a relatively thin layer 27 of tissue-like paper or similar material. The thin layer 27 overlies relatively large and relatively small openings 28 and 29 respectively in the support layer 26, the portion overlying the larger opening 28 having indicia, such as an address imprinted thereon with heat conductive material, such as an ink using carbon as the pigment thereof. The purpose of the small opening 29 will be hereinafter described.

The machine of this invention involves a supporting frame that includes a pair of laterally spaced vertical lower side frame members 30 that are connected at their upper ends by a horizontal frame member 31 and below the frame member 31 by a base member 32 that includes a rearwardly and upwardly sloping portion 33, the base member 32 and side frame members 30 defining a receiver for printed articles. The supporting frame further includes a pair of laterally spaced vertical upper side frame members 34 and 35 rigidly secured at their lower ends to the horizontal frame member 31 at their upper ends by a rearwardly and downwardly sloping top cross frame member 36. Intermediate the frame members 31 and 36, the upper side frame members 34 and 35 are connected by elongated upper and lower brace members 37 and 38 respectively and an elongated heat sink 39, the purpose of which will hereinafter be described.

The frame is at least partially covered by a housing comprising a top member 40 having a top wall 41 and a rear wall portion 42, upper and lower side wall members 43 and 44 respectively, a front housing member 45, a front panel 46, and upper and lower rear panels 47 and 48 respectively, the upper rear panel 47 being hinged at its lower edge, as indicated at 49, to an angle brace member 50 that is rigidly connected at its opposite ends to the lower side frame members 30. The several housing members and panels may be assumed to be rigidly secured to various frame members by suitable means, not shown.

Figure 4:
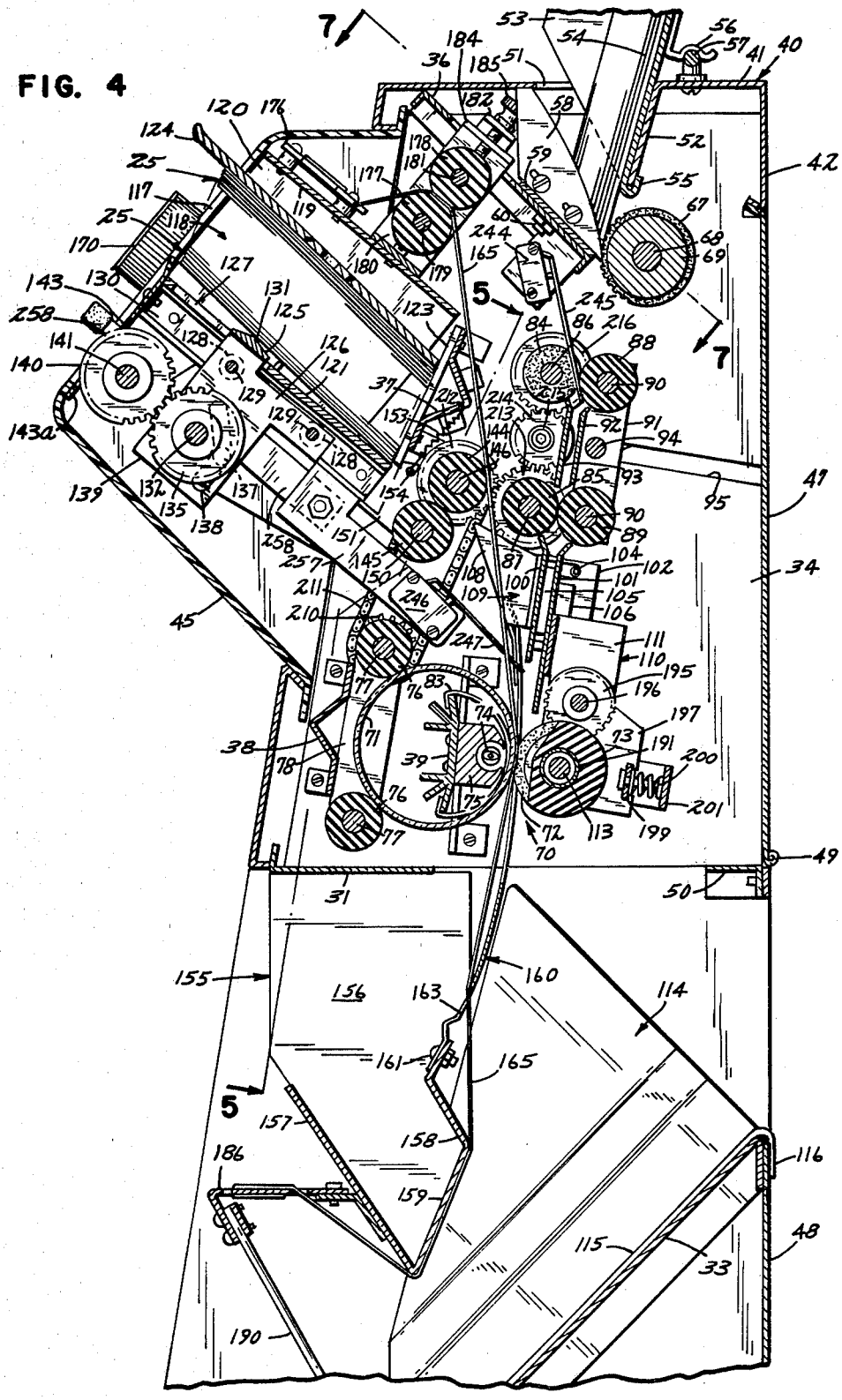
FIG. 4 is an enlarged fragmentary section taken substantially on the line 4—4 of FIG. 1.
Figure 7:
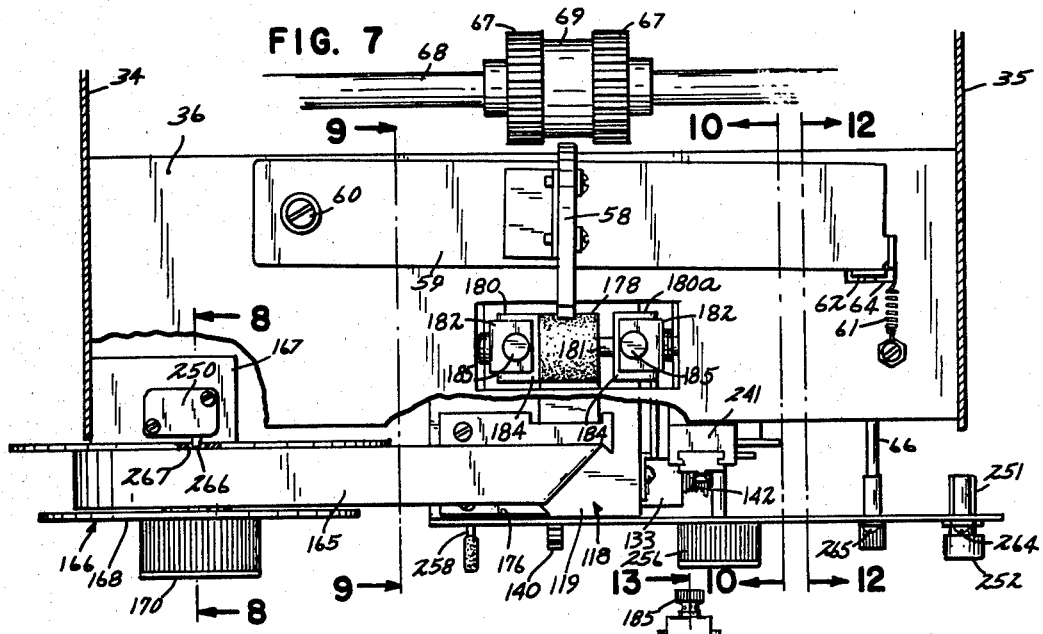
FIG. 7 is a fragmentary view partly in plan and partly in section, taken generally on the line 7—7 of FIG. 4.
Figure 12:
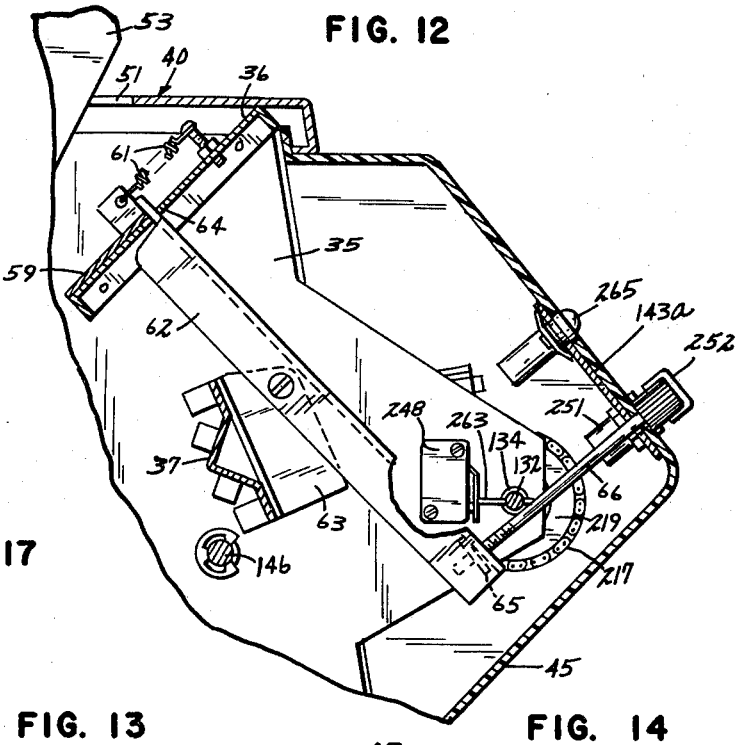
FIG. 12 is an enlarged fragmentary vertical section taken generally on the line 12—12 of FIG. 7.
Figure 17:
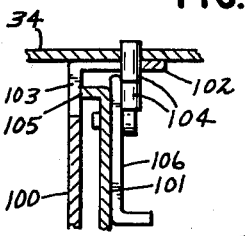
FIG. 17 is a fragmentary section taken on the line 17—17 of FIG. 16.

The top housing member 40 has an elongated opening 51 in the top wall 41 thereof and a downwardly and forwardly sloping flange 52 which cooperate with a pair of laterally movable guide members 53 to provide a magazine for cards, envelopes or other sheet-like members 54, to be printed. For the sake of convenience, the members 54 will be hereinafter described as envelopes. At their lower ends, the guide members 53 have upturned hook portions 55 that engage the lower edge of the flange 52, see particularly FIGS. 2 and 4. The hook portions 55 cooperate with clips 56 that engage an elongated mounting rod 57 to hold the guide members 53 in desired set positions longitudinally of the opening 51 and the mounting rod 57, the guide members 53 being adjustable to accommodate envelopes 54 of various widths. As shown in FIG. 4, the envelopes 54 are supported by a feed control member 58 that is mounted on a lever 59 which is pivotally secured at one end on the top cross frame member 36, as indicated at 60. With reference to FIGS. 7 and 12, it will be seen that the lever 59 is yieldingly urged in one direction of its pivotal movement by a coil tension spring 61. A second lever 62 is pivotally mounted intermediate its ends on a bracket 63 secured to the upper brace member 37, and has an upper end extending through an opening 64 in the top cross frame member 36 to engage the free end portion of the lever 59. At its opposite end, the second lever 62 is provided with a nut element 65 that has screw threaded engagement with an ajustment screw 66 journaled in the front housing member 45, the adjustment screw 66 cooperating with the spring 61 to move the feed control member 58 in opposite directions generally transversely relative to the top wall opening 51. A pair of primary feed rolls 67 have finely toothed cylindrical surfaces and are mounted fast on a shaft 68 that is journaled at its opposite end portions in suitable bearings in the upper side frame members 34 and 35. Intermediate the primary feed rolls 67 is disposed a reduced diameter drum portion 69 that cooperates with the lower end portion of the feed control member 58 to control feeding of the envelopes 54.

Figure 6:
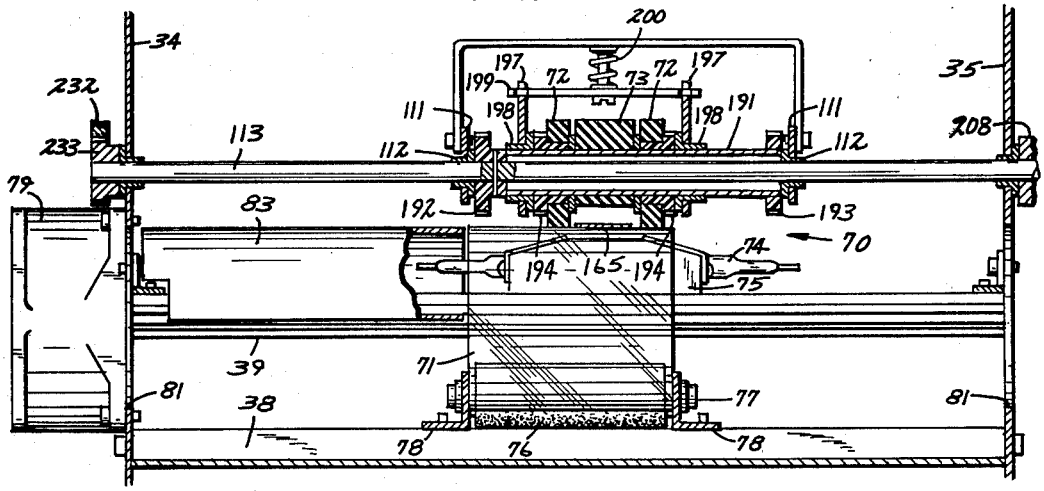
FIG. 6, sheet 3, is a fragmentary horizontal section taken generally on the line 6—6 of FIG. 5.

Envelopes 54 are fed singly from the magazine, by means of the primary feed rolls 67 and other means to be described to a fairly concentrated printing zone indicated generally at 70 in FIGS. 4 and 6, in the bite of a rigid tubular roll 71 and a group of axially aligned rolls including a pair of axially spaced feeding rolls 72 and an impression roll 73 intermediate the feeding rolls 72. As shown in FIGS. 4 and 6, the tubular roll 71 surrounds the longitudinally generally central portion of the heat sink 39 and a conventional infrared heat emitting lamp 74 contained within a holder 75 that is mounted on the heat sink 39. The tubular roll 71 is supported between the feeding rolls 72 and a pair of support rolls 76 mounted fast on shafts 77 journaled in spaced brackets 78 mounted on the lower brace member 38, see FIGS. 4 and 5. The brackets 78 are disposed adjacent opposite ends of the tubular roll 71, and limit axial movement of the roll 71. Preferably, the roll 71 is made of transparent glass or other material suitable for passage therethrough of heat rays radiating from the lamp 74.

Figure 5:
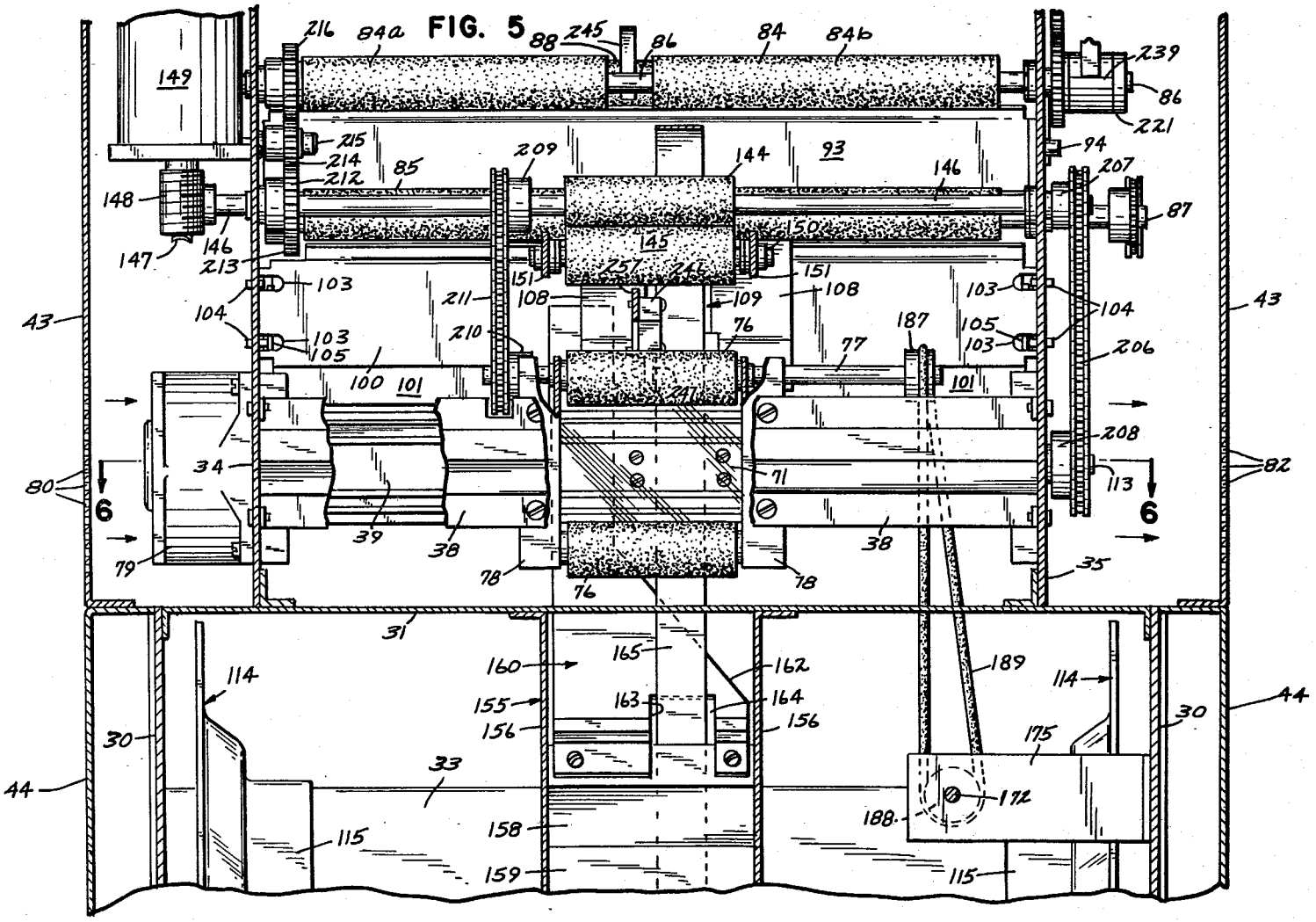
FIG. 5 is a fragmentary view partly in front elevation and partly in section, as seen from the line 5—5 of FIG. 4.

For the purpose of confining heat generated by the lamp 74 to a relatively small area of the machine, a conventional motorized fan, indicated at 79, is shown in FIGS. 5 and 6 as being mounted on the upper frame member 34 in alignment with the tubular roll 71. The fan 79 is adapted to draw cooling air inwardly through a plurality of air inlet openings 80 in the adjacent upper side wall member 43 and discharge the cooling air through a pair of aligned openings 81 in the upper side frame members 34 and 35 and out of the housing through discharge openings 82 in the upper side wall member 43 adjacent the upper side frame member 35. A generally semi-cylindrical shield 83 is shown in FIGS. 4 and 6 as being mounted on the heat sink 39 between the upper side frame member 34 and the tubular roll 71 to aid in guiding cooling air over the heat emitting lamp 74.

Means for feeding and guiding envelopes 54 from the primary feed rolls 67 to the printing zone 70 comprises a pair of generally vertically spaced secondary feed rolls 84 and 85 mounted fast on respective shafts 86 and 87 journaled adjacent their opposite ends in suitable bearings in the upper side frame members 34 and 35, and cooperating idler rolls 88 and 89 on shafts 90 journaled in suitable bearings in end flanges 91 at the opposite ends of a guide plate 92 disposed in rearwardly spaced relation to a cooperating guide plate 93. The guide plate 93 is disposed generally between the secondary feed rolls 84 and 85, and is rigidly secured at its opposite ends to the upper side frame members 34 and 35. A support rod 94 is journaled in the end flanges 91, parallel to the shafts 86, 87 and 90, and has its opposite ends removably mounted in slots 95 in the upper side frame members 34 and 35. The support rod 94 is retained in the slots 95 by a pair of plate-like retainer members 96 having slots 97 therein by means of which the retainer members 96 are slidably and pivotally mounted on the upper side frame members 34 and 35 by screws or the like 98. A pair of coil tension springs 99 are each connected at one end to a respective one of the upper side frame members 34 and 35 and at their opposite ends to respective ones of the retainer members 96, see FIGS. 2 and 3, to yieldingly urge the support rod 94 in a direction to press the idler rolls 88 and 89 into tangential contact with their respective secondary feed rolls 84 and 85. The retainer members 96 may be moved away from the ends of the support rod 94 and pivotally moved to permit removal of the guide plate 92 and idler rolls 88 and 89, for cleaning or other service when required.

It should here be noted that the feed control member 58, primary feed rolls 67, feeding and impression rolls 72 and 73, support rolls 76, secondary feed rolls 84 and 85, and idler rolls 88 and 89 are all of rubber or similar elastic materials. With reference particularly to FIG. 5, it will be seen that the upper secondary feed roll 84 comprises a pair of axially spaced feed roll sections **84*a* and 84*b***, for a purpose which will hereinafter become apparent.

Figure 20:
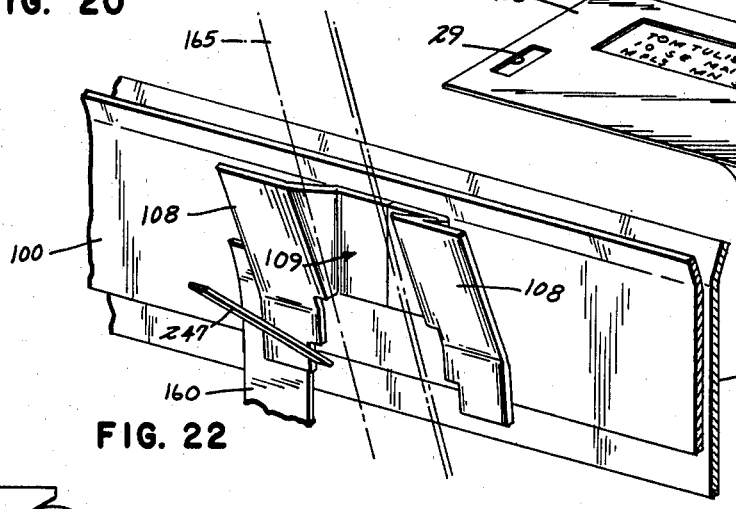
FIG. 20 is a fragmentary detail in perspective of a portion of guide means for master cards, printing tape and envelopes of this invention.

A pair of laterally spaced parallel lower guide plates 100 and 101 are disposed generally below the rolls 85 and 89 respectively, to guide envelopes 54 from the secondary feed rolls 84 and 85 to the bite 70 of the printing zone. The guide plate 100 is formed to provide mounting flanges 102 at its opposite ends each of which engages an opposite one of the upper side frame members 34 and 35, and each of which is provided with a pair of slots 103 that receive mounting and locking pins 104 that project laterally inwardly from respective ones of the upper side frame members 34 and 35, see particularly FIGS. 2, 5, 16 and 17. At its opposite ends, the guide plate 101 is formed to provide interned flanges 105 that are adapted to engage the guide plate 100 to hold the guide plates 100 and 101 in predetermined spaced relationship. A pair of latches 106 are each pivotally mounted adjacent a different end of the guide plate 101, as indicated at 107, and are adapted to be moved into latching engagement with one of the locking pins 104, to hold both of the guide plates 100 and 101 in their operative positions shown. With reference particularly to FIGS. 4, 5 and 20, it will be seen that the guide plate 100 is provided with a pair of guide members 108 that define therebetween a passageway 109.

Figure 2:
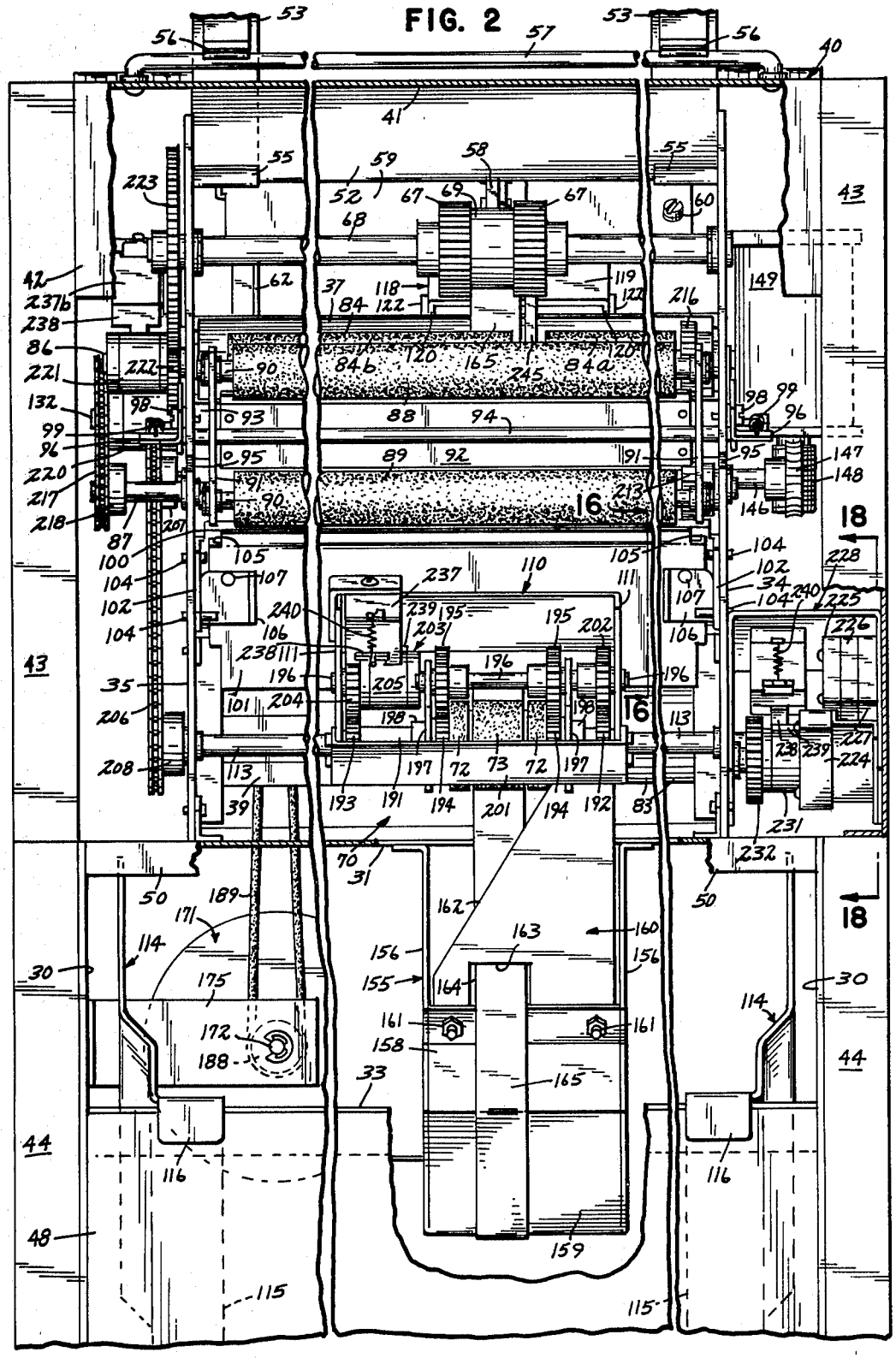
FIG. 2 is an enlarged view in rear elevation of the machine of FIG. 1, some parts being broken away and some parts being removed.

The guide plate 101 has secured thereto intermediate its ends a generally U-shaped bracket 110 having downwardly extending legs 111 which at their lower ends are pivotally mounted, by means of bearings 112, on a shaft 113 which in turn is journaled in suitable bearings in the upper side frame members 34 and 35, see particularly FIGS. 2 and 6.

As envelopes 54 are fed downwardly from the printing zone, they drop by gravity into the envelope receiver defined by the lower side frame members 30 and base member 32, wherein a pair of laterally adjustable guide members 114 are mounted on the sloping portion 33 of the base member 32. Each guide member 114 is provided with a base flange portion 115 that rests upon the sloping base portion 33, each base flange portion 115 being provided at its upper end with a downturned hook 116 that engages the upper edge of the lower rear panel 48 to support its respective guide member 114 in place.

The front housing member 45 defines a generally rectangular opening 117 through which a plurality of master cards are placed in stacked formation into a magazine 118 that is supported on the intermediate portion of the upper brace member 37. The magazine has a top wall 119, opposite side walls 120 and a bottom wall 121. A pair of mounting plates 122 are rigidly secured to the side walls 120, and are provided with threaded studs 123 by means of which the magazine 118 is secured to the upper brace member 37. As shown in FIG. 4, the magazine 118 slopes rearwardly and downwardly from the opening 117, and a stop bar 123, secured to the brace member 37 limits inward movement of the stack of master cards 25. The lower end of the stop bar 23 is spaced above the magazine bottom wall 121 a distance only slightly greater than the thickness of a single master card 25, so that the bottom card only may be fed from the magazine at any given time. A plate-like weight 124 is placed over the stack of master cards 25 to assist in feeding of the master cards downwardly toward the bottom wall 121, while holding the cards 25 against movement away from abutting engagement with the stop bar 123.

Means for feeding the master cards 25 in succession from the magazine 118 toward the printing zone comprises a picker head 125 that is mounted on a carriage 126 disposed below the bottom wall 21 and which has a portion projecting upwardly through an opening 127 in the bottom wall 121. The carriage 126 includes pairs of rollers 128 journaled on shafts 129, the rollers being contained in guide channels 130 mounted on the underside of the magazine bottom wall 121. The picker head 125 is formed to provide a tooth 131 that is adapted to engage each master card support layer 26 at one side of the small opening 29 thereof and move the lowermost card 25 in the stack thereof rearwardly and downwardly out of the magazine 118.

Figure 11:
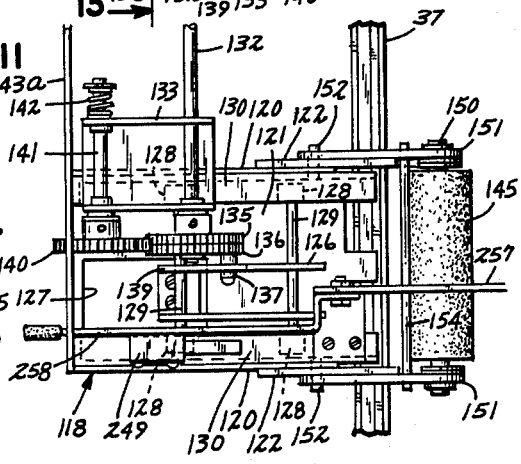
FIG. 11 is a fragmentary view in bottom plan of the mechanism shown in FIG. 10.
Figure 16:
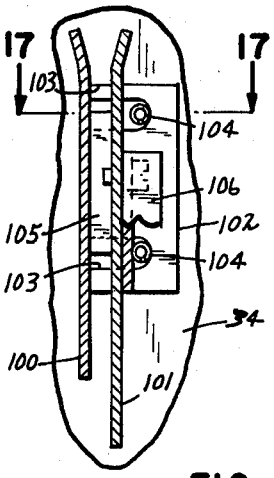
FIG. 16 is an enlarged fragmentary detail in section, taken on the line 16—16 of FIG. 2.
Figure 13:
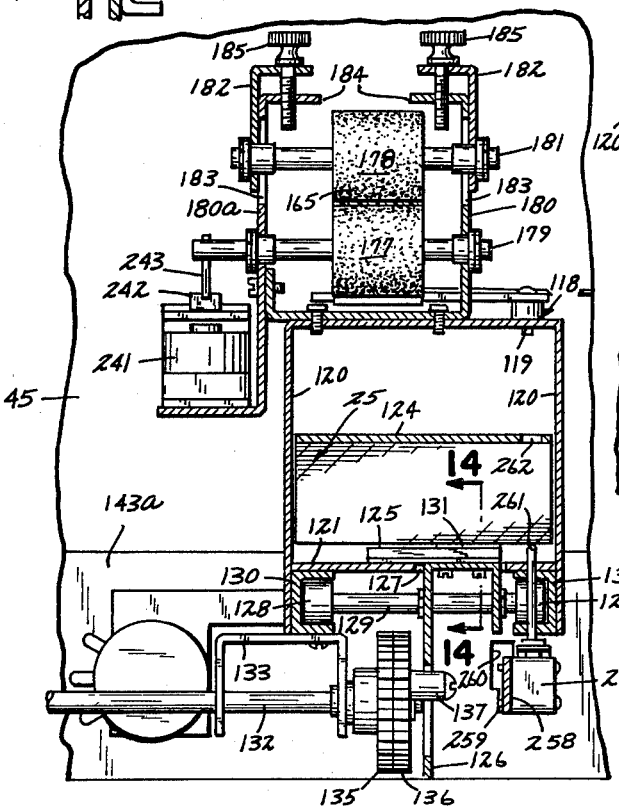
FIG. 13 is an enlarged fragmentary section taken on the line 13—13 of FIG. 9.

Means for imparting card feeding movements to the carriage 126 and picker head 125 comprises a power driven shaft 132 that is journaled in a bearing mounted in a bracket 133 secured to one of the guide channels 130, see FIG. 13, and in another bearing 134 in the upper side frame member 35, see FIG. 12. A pair of gears 135 and 136 are mounted on the inner end portion of the shaft 132, the gear 135 being pinned or otherwise rigidly secured to the shaft 132 for rotation therewith, the gear 136 being journaled on the shaft 132. The gear 136 is provided with a crank pin or roller 137 that is received in a slot 138 in a drive flange 139 secured to the carriage 126. A clutch gear 140 is mounted fast on a shaft 141 that is rotatably and axially movable in the bracket 133 between an adjustment position wherein the gear 140 is in mesh only with the gear 136, and a driving position wherein the gear 140 is in meshing engagement with both gears 135 and 136, as shown in FIG. 11. A coil compression spring 142 is disposed to yieldingly urge the gear 140 in its axial movement toward engagement with both gears 135 and 136. The gear 136 can be rotated independently of the gear 135 so as to vary the position of said crank pin 137 circumferentially with respect to the gear 135, and thus vary timing of feeding movement of master cards 25 in relation to that of the envelope feeding mechanism. This timing variation enables the indicia on the master card 25 to be reproduced in a desired position on a given envelope 54. As shown, the clutch gear 140 projects outwardly through an opening 143 in a plate **143*a* disposed in the opening 117 of the front housing member 45**.

As each card 25 is moved outwardly from the magazine 118, it passes to a bite between a card feeding roll 144 and a cooperating idler roll 145. The card feeding roll 144 is mounted fast on a drive shaft 146 that is journaled in bearings in the upper side frame members 34 and 35 and, adjacent the frame member 34, has mounted fast thereon a worm gear 147 that has meshing engagement with a drive worm 148 mounted fast on the drive shaft of a motor 149. The motor 149 is shown in FIGS. 2 and 5 as being mounted on the upper side frame member 34. The idler roll 145, like the card feeding roll 144, is preferably made of rubber or similar material, and is mounted on a shaft 150 that is journaled in bearings in a pair of spaced arms 151 each pivotally secured to a different one of the magazine mounting plates 122, by means of pivot pins or the like 152. The idler roll 145 is yieldingly urged into engagement with the card feeding roll 144 by a coil tension spring 153 connected at one end to the brace member 37, and at its other end to a cross bar 154 extending between the arms 151.

As each master card 25 is fed rearwardly and downwardly by the card feeding roll 144, the leading edge of the card 25 engages the guide members 108 which direct the card downwardly toward the bite 70 between the tubular roll 71 and the rolls 72 and 73 in the printing zone. A master card receiver 155 is suspended below the horizontal frame member 31, and comprises a pair of side wall members 156 secured at their upper ends to the frame member 31, and a hopper-like portion defining spaced front and rear walls 157 and 158, the latter of which has a lower portion 159 that converges downwardly with the front wall portion 157. The master cards are guided through the printing zone by a thin flexible separator plate 160 that is secured at its lower end to the upper edge portion of the card receiver rear wall 158, as indicated at 161, the separator plate extending upwardly through the printing zone 70, terminating at its upper end between one of the guide members 108 and the guide plate 100, see particularly FIGS. 2, 4 and 5. It will be noted that the lower end of the separator plate 160 is of substantially greater width than the upper end thereof, the plate 160 defining a sloping upper edge portion 162 just below the printing zone 70. Further, at its lower end portion, the separator plate 160 is provided with a notch 163 that cooperates with the upper edge of the rear card receiver wall 158 to provide an opening 164. With reference particularly to FIGS. 4 and 20, it will be noted that each master card 25 will be directed downwardly in front of an envelope 54 by the guide members 108 and the separator plate 160, the upper end of the separator plate 160 being disposed between one of the guide members 108 and the guide plate 100 on which it is mounted.

For the purpose of reproducing on the envelopes 54, indicia on the master cards 25, a length of sheet material, hereinafter designated as printing tape 165, is provided and fed through the printing zone 70. The tape 165 is made from a suitable flexible synthetic plastic material, such as "Mylar" coated on one surface with a printing medium, such as carbon, suspended in a suitable wax. The coating of wax and printing medium is disposed on a side of the tape 165 facing an envelope 54, the tape 165 being disposed between a master card 25 and an envelope 54 in the printing zone 70. Thus, when heat is applied to a master card 25 by the lamp 74, in the printing zone 70, heat from the lamp 74 is conducted through the carbon indicia on the master card to the tape 165, so as to melt the wax vehicle behind only the printed indicia of the master card 25, so that the melted portion of the coating is transferred to the envelope 54 and the indicia from the master card 25 is reproduced on the envelope 54.

Figure 1:
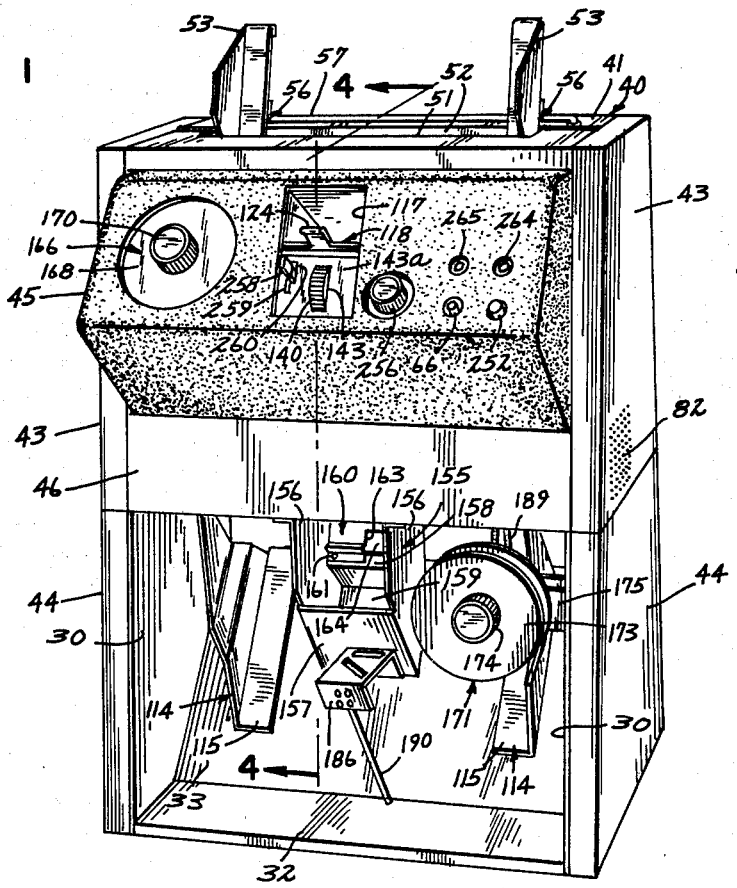
FIG. 1 is a view in perspective of the addressing machine of this invention as seen from the front, top and one side thereof.

The tape 165 is initially rotatably coiled on a stationary spool 166 that is mounted on a bracket 167 extending laterally inwardly from the upper side frame member 34, the spool 166 including an outer cover plate 168 removably secured to the spool 166 by a mounting screw or stud 169 and a retaining knob 170 screw threaded on the stud 169. A take-up spool 171 is similar in construction to the spool 166, but is mounted for rotation on a shaft 172, the take-up spool being adapted to receive and wind up tape 165 that has passed through the printing zone 70. The take-up spool 171 includes an outer cover plate 173 that is held in place by a knob 174 that is screw threaded or otherwise removably secured on the shaft 172. The shaft 172 is journaled in suitable bearings in a mounting bracket 175 extending laterally inwardly from the lower side frame member 30 underlying the upper side frame member 35, as shown in FIGS. 1, 2 and 5.

The tape 165 is guided from the supply spool 166 toward the printing zone 70 by an upper guide plate 176 mounted on the top wall 119 of the master card magazine 118, and a pair of rubber-like restraining or tensioning rolls 177 and 178. The roll 177 is mounted on a rotary shaft 179 journaled in a pair of brackets 180 and **180*a* secured together and to the magazine 118, the roll 178 being mounted on a shaft 181 journaled in brackets 182, each of which is generally vertically movable on a different bracket 180 and 180*a*. The brackets 180 and 180*a* are provided with aligned slots 183 through which opposite portions of the shaft 181 extend, to permit generally vertical movement of the brackets 182 and similar movement of the roll 178 toward and away from the roll 177. The brackets 180 and 180*a* are formed to provide inturned ears 184 which screw threadedly receive a pair of adjustment screws 185 that are journaled in inturned portions of the brackets 182. The adjustment screws 185 are utilized to impart predetermined pressure of the roll 178 against the roll 177 and a portion of the tape 165 passing through the bite of the rolls 177 and 178. As will hereinafter appear, the roll 177, like the roll 178**, is free to rotate at predetermined intervals, and held against rotation during other intervals.

During the interval in which the roll 177 is free to rotate, pressure of the roll 178 thereagainst and against the tape 165 therebetween applies sufficient restraining force on the tape to prevent slack therein during movement thereof through the printing zone 70, but does not interfere with the speed of movement of tape through the printing zone 70. When the roll 177 is held against rotation, it and the roll 178 operate to hold the tape 165 against feeding movement toward the printing zone 70. Thus, the rolls 177 and 178 operate to meter a predetermined length of tape 165 with movement of each master card 25 to the printing zone 70.

As the tape 165 moves away from the rolls 177 and 178, it is guided toward the printing zone 70 by the guide members 108, as shown in FIG. 20, the tape 165 moving in front of the separator plate 160 as it moves away from the printing zone 70. As shown particularly in FIGS. 2, 4 and 5, the tape moves downwardly through the opening 164 and downwardly into sliding engagement with the rear surface of the lower rear wall portion 159 of the master card receiver. From thence, the tape 165 is fed over a guide plate 186 to the take-up spool 171. It will here be noted that the take-up spool 171 is driven from the shaft 77 by pulleys 187 and 188 rigidly mounted on the shafts 77 and 172 respectively, and a flexible drive belt 189 entrained over the pulleys 187 and 188. With reference to FIGS. 1 and 4, it will be seen that the lower tape guide plate 186 has rigidly secured thereto the upper end of a flexible retainer bar 190 which yieldingly holds printed envelopes 54 in the envelope receiving portion of the machine.

The impression roll 73 is mounted fast on a tubular member 191 that loosely encompasses the shaft 113 between the legs 111, see particularly FIGS. 4 and 6. A gear 192 is mounted fast on the shaft 113 intermediate one end of the tubular member 191 and the adjacent leg 111. Adjacent the opposite end of the tubular member 191, the same is provided with a gear 193 mounted fast thereon. The feeding rolls 72 are mounted fast on gears 194 that are journaled on the tubular member 191, the gears 194 each having meshing engagement with a different one of a pair of gears 195 fast on a jack shaft 196 that is journaled in a pair of spaced brackets 197 mounted on the tubular member 191 by bearings 198. With reference to FIG. 2, it will be noted that the jack shaft 196 has opposite ends journaled in bearings in the legs 111, so that the brackets 197 and tubular member 191 may partake of pivotal movement on the axis of the shaft 196 while maintaining intermeshing engagement between the gears 194 and their cooperating gears 195. As shown in FIG. 6, a coil compression spring 200 is interposed between the cross bar 199 and the intermediate portion of a generally U-shaped connector bar 201 that has its opposite ends rigidly connected each to a different one of the legs 111 of the bracket 110. The spring 200 yieldingly urges the tubular member 191 and rolls 72 and 73 carried thereby toward engagement with the tubular roll 71, whereby to press master cards 25, envelopes 54 and tape 165 together and against the tubular roll 71 at the printing zone 70.

A gear 202 is mounted fast on the jack shaft 196, and has intermeshing engagement with the gear 192, to impart rotary movement from the shaft 113 to the feeding rolls 72. A commercially available clutch 203 is mounted on the shaft 196 and has an output gear 204 that has meshing engagement with the gear 193 to impart rotation to the tubular member 191 and impression roll 73. The clutch 203 is of the type disclosed in U.S. Pat. No. 3,926,286, and includes a clutch release sleeve 205.

Figure 3:
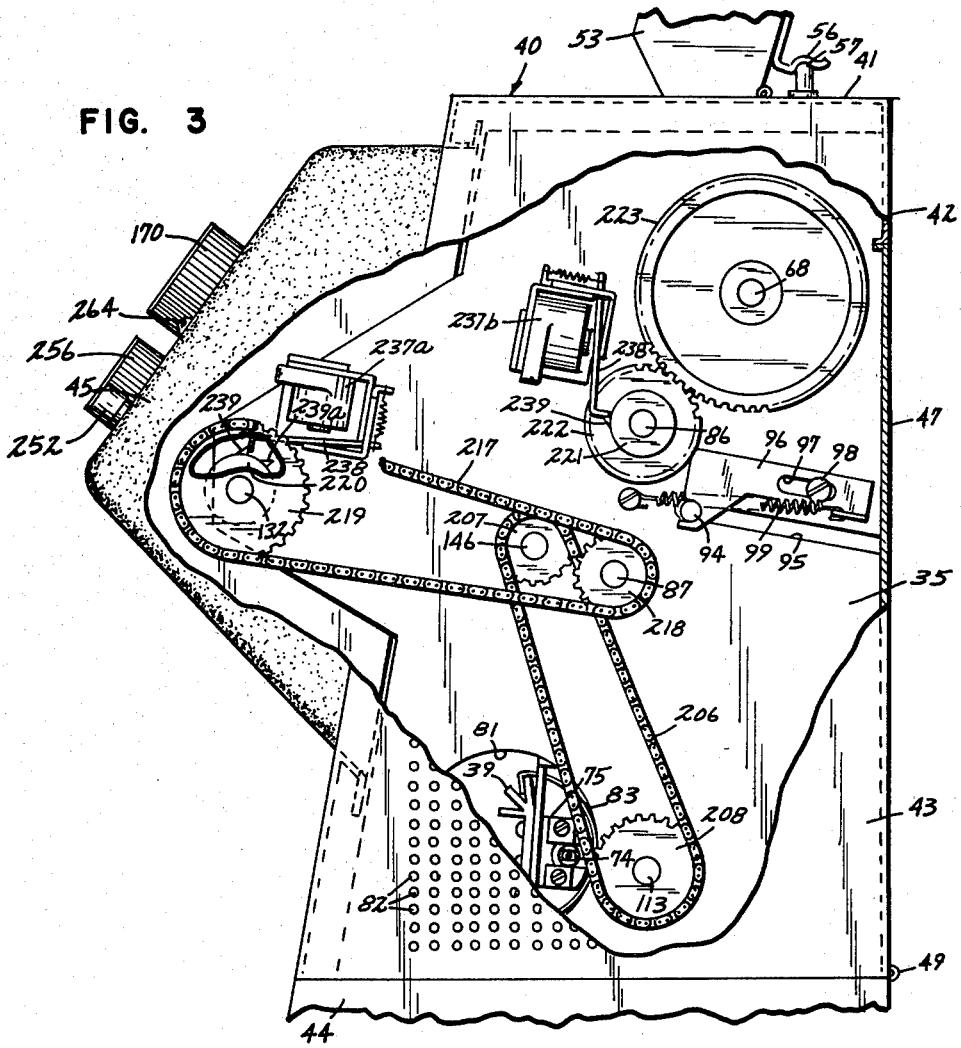
FIG. 3 is an enlarged fragmentary view in side elevation, as seen from the right with respect to FIG. 1, some parts being broken away.

With reference to FIG. 3, it will be seen that the shaft 113 is driven from the drive shaft 146 by an endless link chain 206 that is entrained over a sprocket wheel 207 on the drive shaft 146 and a second sprocket wheel 208 on the shaft 113, between the upper side frame member 35 and the adjacent upper side wall member 43. The drive shaft 146 has a sprocket wheel 209 thereon, see FIG. 5, that is operatively connected to a sprocket wheel 210 on the shaft 77 by an endless link chain 211, for imparting rotation to the tubular roll 71.

The secondary feed rolls 84 and 85 are driven from the drive shaft 146 by gears 212 and 213 mounted on the shafts 146 and 87 respectively, the gear 213 having intermeshing engagement with an idler gear 214 journaled on a stub shaft 215 mounted on the upper side frame member 34, the idler gear 214 having meshing engagement with a second gear 216 mounted fast on the shaft 86 adjacent the upper side frame member 34, see FIGS. 4 and 5. The card feeding shaft 132 is driven from the shaft 87 by an endless link chain 217 entrained over a sprocket wheel 218 on the shaft 87 and a second sprocket wheel 219 that drives the shaft 132 through the medium of a clutch 220 similar to the clutch 205. The primary feed rolls 67 are driven from the shaft 86 by means of a clutch 221 on the shaft 86, a gear 222 driven by the clutch 221, and a gear 223 mounted fast on the shaft 68 and having intermeshing engagement with the gear 222.

Figure 18:
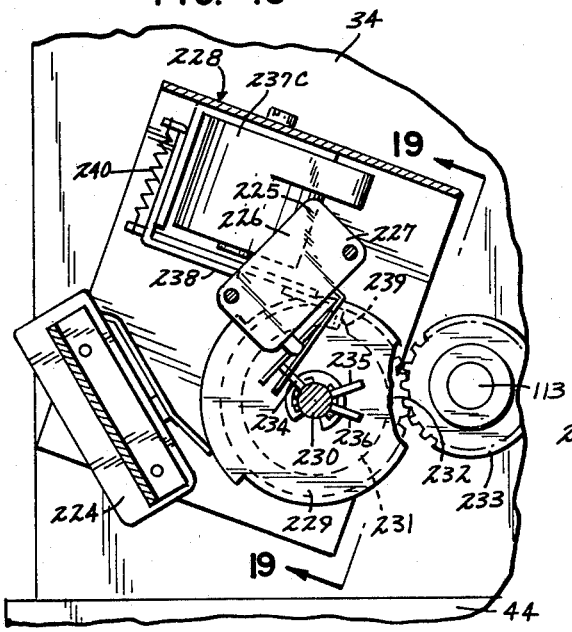
FIG. 18 is an enlarged fragmentary section taken on the line 18—18 of FIG. 2.
Figure 19:
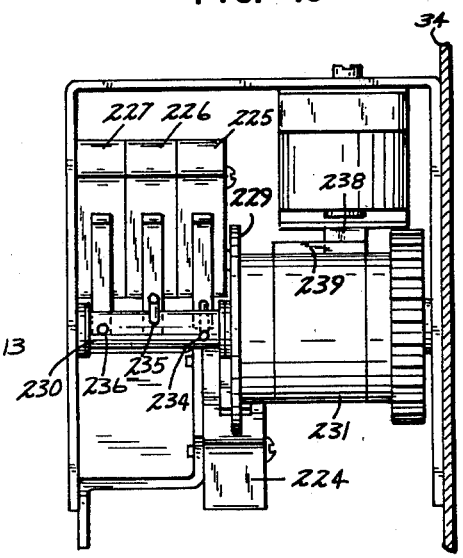
FIG. 19 is a fragmentary detail partly in section and partly in front elevation, as seen from the line 19—19 of FIG. 18.

A plurality of switches 224, 225, 226 and 227 are mounted in a bracket assembly 228 that is rigidly secured to the upper side frame member 34, see FIGS. 2, 18 and 19. The switch 224 is operated by a cam 229 mounted on the output shaft 230 of a clutch 231 similar to the clutches 203, 220 and 221, the output shaft 230 being journaled in the bracket assembly 228. The clutch 231 is driven by a gear 232 thereon having intermeshing engagement with a gear 233 fast on the drive shaft 113. The switches 225, 226 and 227 are each operated by a respective pin 234, 235 and 236 extending radially outwardly of the shaft 230.

Each of the clutches 203, 220, 221 and 231 are operated by respective ones of a plurality of solenoids 237, **237*a*, 237*b* and 237*c*, having armatures 238 that engage teeth 239 on their respective clutches 231, 220, 221 and 205. The armatures 238 are each yieldingly urged toward engagement with the teeth 239 on their respective clutches by coil tension springs 240. When the several solenoids 237 are de-energized, their respective clutch operated shafts are stationary. Energization of any one of the solenoids 237 will cause removal of its respective armature 238 from engagement with its respective tooth or abutment 239, whereby to cause its respective shaft to rotate until the solenoid is again de-energized and its armature 238 again engaging its respective tooth 239**.

Figure 10:
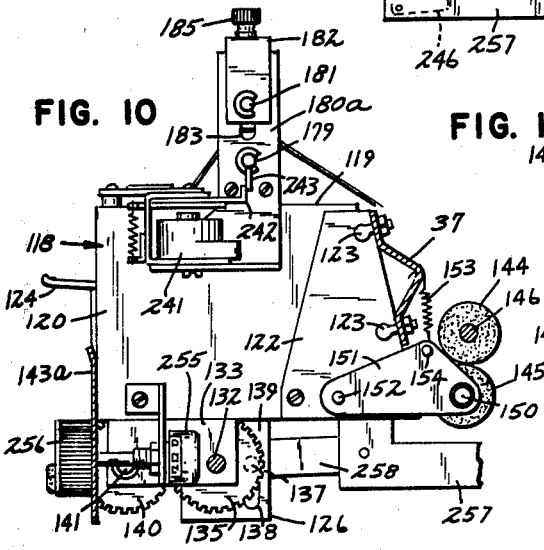

With reference to FIGS. 10 and 13, it will be seen that rotation of the shaft 179 and its roll 177 is controlled by a further solenoid 241 having an armature 242 that is spring biased toward the path of travel of a pin 243 that extends radially outwardly from the shaft 179. When the solenoid 241 is energized, the shaft 179 is permitted to rotate.

Figure 22:
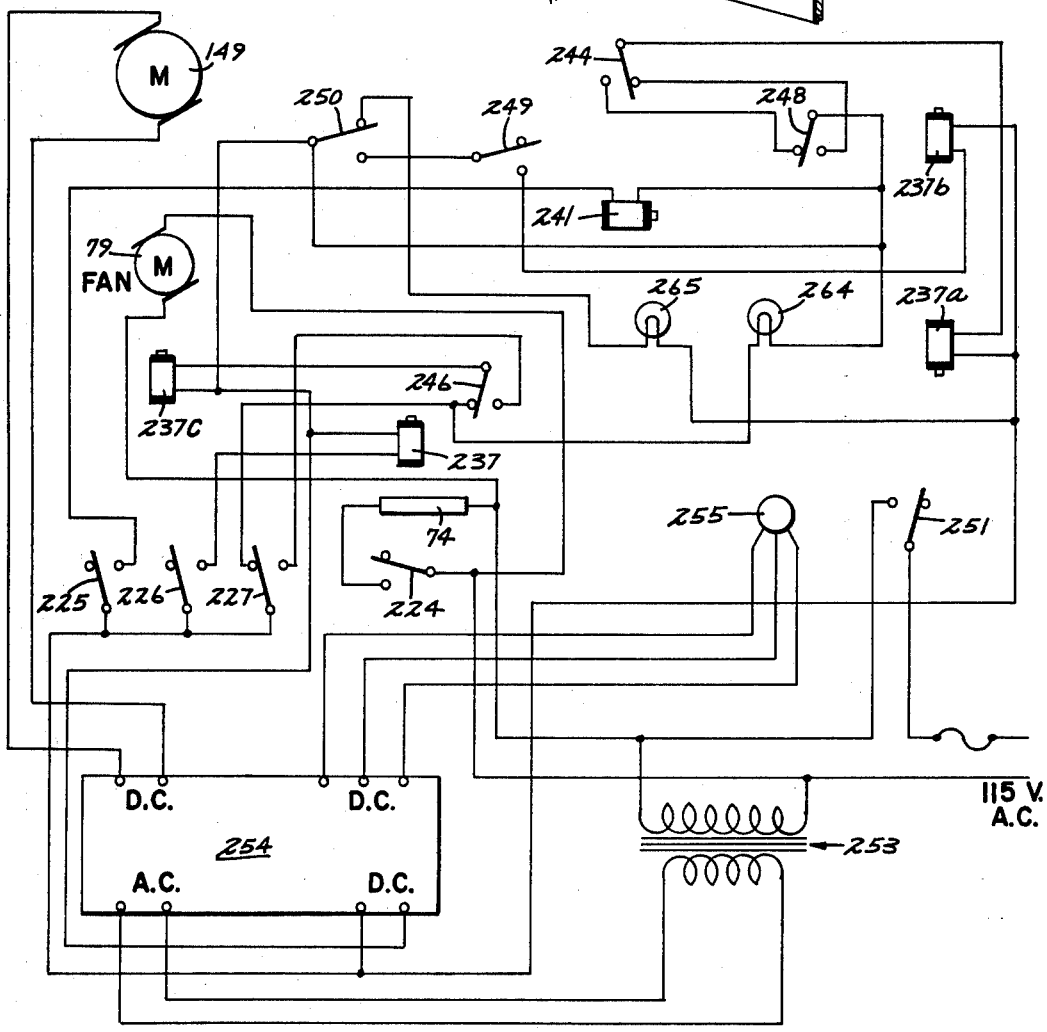
FIG. 22 is a wiring diagram.

Means for controlling operation of the machine includes the above-described switches 224–227, an envelope-engaging or picker switch 244 carried by the top cross frame member 36 and having an envelope-engaging arm 245 that is normally disposed between the sections **84*a* and 84*b* of the secondary feed roll 84; a master card operated timer control switch 246 having a switch arm 247 that extends downwardly and rearwardly into the path of travel of master cards adjacent the guide members 108, see FIGS. 4 and 20. Other control switches include an interlock switch 248 for the envelope engaging switch 244, a master card controlled cut-off switch 249, and a tape controlled cut-off switch 250. As shown in the diagram of FIG. 22, the heating lamp 74 and its control switch 224, together with the motor of the fan 79, are disposed in a high voltage fuse-equipped circuit that includes a manually operated master switch 251 having a control button 252 shown in FIGS. 1, 7 and 12, the balance of the circuitry being low voltage direct current supplied by a transformer 253 and a converter 254 having a direct current output. A potentiometer 255, having a control knob 256, regulates the speed of the drive motor 149** in the usual manner.

Figure 9:
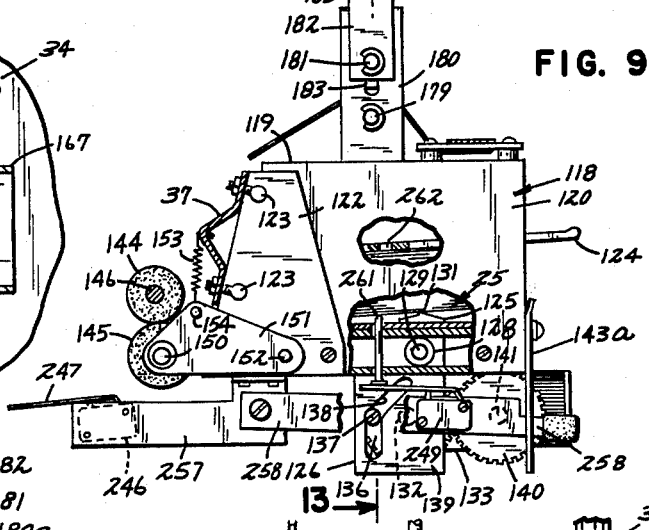
FIGS. 9 and 10 are fragmentary details, partly in elevation and partly in section, taken on the lines 9—9 and 10—10 respectively of FIG. 7.

As shown in FIGS. 4 and 9, the master card operated switch 246 is mounted on an angle bracket 257 that is rigidly connected to the magazine 118. The cut-off switch 249 is mounted on an arm 258 pivotally secured at its inner end to the bracket 257, the arm 258 extending outwardly through an opening 259 in the plate **143*a*, the opening having a recess portion 260, see FIG. 13. The switch 249 is normally held in a switch closed position by a switch engaging pin 261 that extends slidably through suitable openings in one of the guide channels 130 and the bottom wall 121 of the magazine 118 and which engages the lowermost one of the master cards within the magazine 118. The weight 124 has an opening 262 therethrough which loosely receives the pin 261 when the supply of master cards 25 is exhausted from the magazine 118, to permit opening of the cut-off switch 249. It will be noted, with reference to FIG. 13, that during normal operation of the machine, the switch supporting arm 258 is received in the recess 260. When the supply of master cards is exhausted from the magazine, the switch 249 will operate to de-energize the envelope feeding mechanism. Before inserting a fresh supply of master cards into the magazine 118, the switch supporting arm 258 is swung downwardly to the bottom of the opening 259, after which the weight 124 is removed and new cards 25 added to the magazine. With the arm 258 in its lowered position, the switch 249 will remain closed until the arm 258 is raised into the recess portion 260**, at which time the envelope feeding mechanism will begin to operate.

Figure 8:
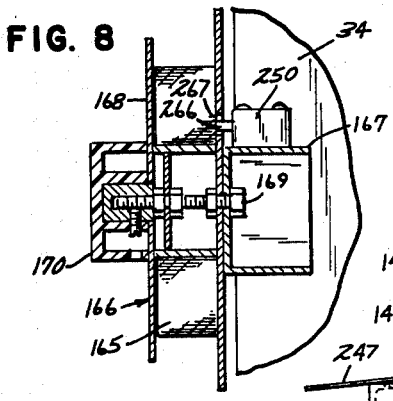
FIG. 8 is a fragmantary detail in section taken generally on the line 8—8 of FIG. 7.

The interlock switch 248 is a normally open switch, and is mounted on the upper side frame member 35 to be operated by a finger 263 projecting radially outwardly from the shaft 132, see particularly FIG. 12. With reference to FIG. 3, it will be seen that the clutch 220 is provided not only with an abutment 239, but also with a second abutment 239*a* circumferentially spaced from the abutment 239. A lamp 264 on the front housing member 45 indicates that the machine is on. This lamp also indicates that one or more master cards 25 are in the magazine 118. A second lamp 265, mounted in the front housing member 45, is disposed in a circuit in series with the switch 250 and is energized when the supply of tape 165 in the spool 166 reaches a predetermined minimum. The switch 250 is mounted on the bracket 167 and has its actuating pin 266 extending through an opening 267 in the spool 166, to engage the roll of tape 165 therein, see FIG. 8.

As should be evident from the schematic wiring diagram of FIG. 22, the switch 225 is operative to energize the solenoid 241 to permit feeding of tape 165 at a given time. The switch 226 is operative to energize the solenoid 237*c* to cause rotation of the impression roll 73. The switch 227 is an interlock switch for the card operated timer switch 246.

Operation

With the magazine 118 loaded with master cards 25, the weight 124 in place, and a supply of envelopes 54 disposed between the guide members 53 and resting on the feed control member 58, closing of the master switch 251 will energize the motor of the fan 79 and the drive motor 149 to impart rotation to shafts 146 and 113. At this point, the armature 238 of the solenoid 237*a* will engage the abutment 239 of the clutch 220. As an envelope 54 is fed downwardly, the same closes the switch 244 which energizes the solenoid 237*a*, causing the shaft 132 to begin rotation. As the shaft 132 rotates, it imparts feeding movement to the picker head 125 to feed the lowermost card 25 in the stack thereof toward the rolls 144 and 145. At the same time, an envelope 54 is descending toward the printing zone 70. As the master card 25 moves into the printing zone 70, it trips the switch 246 to energize the solenoid 237 and cause rotation to be imparted to the impression roll 73. It will be noted that the tape 165 is wound on the take-up spool 171, but is not rigidly secured thereto so that slippage may occur between the spool 171 and the tape 165. When the master card 25 engages the tape 165 just before entering the printing zone, the solenoid 241 is energized to permit rotation of the rolls 177 and 178, so that the tape 165 may be fed through the printing zone at the same speed as the master card 25 and envelope 54. As the envelope 54 and master card 25 begin to move through the printing zone 70, the infrared lamp 74 is energized. This energization occurs approximately one-eighth of a second before the master card opening and causes the card and tape 165 to become momentarily preheated as they move through the printing zone, which improves the quality of image reproduction. When the master card is exposed to the infrared lamp 74, the indicia, due to the carbon in the ink, absorb heat much more rapidly than does the unprinted portion of the thin layer 27. Heat from the master card 25 is therefore selectively transferred to the tape coating in the image of the indicia, causing that portion of the tape coating directly underlying the indicia to become heated to the degree necessary for transfer from the tape 165. At the same time, the impression roll 73 presses the envelope 54 against the coated surface of the tape 165, the tape 165 against the printed indicia of the master card 25, and the master card 25 against the rotating tubular roll. This pressure, coupled with the selective heating mentioned above, causes that portion of the tape coating corresponding to the indicia on the master card 25 to transfer from the tape 165 and adhere to the envelope 54.

It will be appreciated that the image transferring process is dependent on a number of variables, among them the wattage or heating capability of the infrared lamp 74 and the length of time that the master card 25 and tape 165 are exposed to the energized infrared lamp 74. If this exposure time is too long given the heating capability of the lamp 74, the unprinted portion of the master card 25 and tape coating also become hot, and more of the tape coating than the image-selected portions may be improperly transferred. Of course, if this exposure time is insufficient, the resulting transfer will be less than the desired image and perhaps unreadable. The timing of energization and de-energization of the lamp 74 is controlled directly by the cam 229 and switch 224 operated thereby.

In this regard, a lamp of the infrared type is preferred since it is capable of intermittent operation, instantaneously and uniformly generating the heat necessary to effect optimum image transfer. This not only enables precise control of the process to reproduce the best possible image, but also conserves energy, limiting lamp usage to those times when it is needed.

Other variables of the image transferring process are the degree of pressure offered by the impression roll 73 and tubular roll 71 on the moving card 25, tape 165 and envelope 54, which can be controlled by adjustment of the spring 200; and the speed of movement of the master card 25, envelope 54 and tape 165 through the printing zone 70, which is controlled by the rheostat or potentiometer 255.

When the printed portion of the master card 25 has moved beyond the printing zone 70, the cam 229 opens the switch 224 to de-energize the lamp 74. During movement of the master card 25 through the printing zone 70, the master card feeding shaft 132 is stopped by engagement of the armature 238 of the solenoid 237*a* with the abutment 239*a* of the clutch 220. At this time, the switch operating finger 263 is out of engagement with the switch 248. Then, as the trailing edge of the envelope 54 passing through the printing zone 70 leaves the switch arm 245, a circuit is again momentarily closed through the solenoid 237*a* so that the clutch 220 and shaft 132 rotate only sufficiently for the switch operating finger 263 to reclose the switch 248, at which time the circuit to the solenoid 237*a* is again opened and the armature 238 thereof moves into engagement with the abutment 239 on the clutch 220. At this point, the operating circuit for the machine is in readiness to feed another master card from the magazine 118 when a subsequent envelope 54 operates the switch arm 245.

It will be noted that as the envelope, card and tape approach the printing zone, a portion of the envelope 54 is disposed behind the separator plate 160, the card and tape being disposed in front of the separator plate 160. As each master card 25 and the tape 65 leave the printing zone 70, the tape 165 moves downwardly through the notch 163 in the separator plate, the master card being deposited in the receiver 155 therefor.

The switch operating pins 234, 235 and 236 are so disposed angularly with respect to each other that the solenoids 241, 237*c* and 237, controlled by their respective switches 225, 226 and 227 operate in definite timed relationship to properly feed master cards and tape when an envelope 54 is fed through the feeding zone. It should be noted that the solenoid 241 is de-energized as soon as the indicia on a master card 25 leaves the printing zone, so as to enable the armature 242 thereof to engage the pin 243 and bring the rolls 177 and 178 as well as the tape 165 to a sudden stop. The tape 165 tends to adhere to the printed portion of the addressed envelope 54, and the sudden stopping of the tape jars the same loose from the envelope. This separation is aided by the separator plate 160 as hereinbefore described.

While we have shown and described a commercial embodiment of our addressing machine, and described a method of addressing cards and envelopes, it will be understood that the same is capable of modification without departure from the spirit and scope of the invention, as defined in the claims.

What is claimed is:

1. A method of reproducing material imprinted on a master element having indicia of heat conducting material thereon, comprising:

(a) feeding the master element through a printing zone in which a heating element is disposed;

(b) feeding a print receiving member through the printing zone outwardly of the master element relative to the heating element and in the same direction as the master element;

(c) supporting a length of flexible sheet material provided with a heat transferable printing medium under predetermined tension between the master element and the print receiving member;

(d) intermittently advancing a predetermined length of the flexible sheet material through the printing zone against its supporting tension in the same direction as the master element;

(e) and pressing the master element, flexible sheet material and printing receiving member together during movement thereof through the printing zone.

2. The method defined by claim 1, wherein the heating element comprises a lamp disposed within a rotatably mounted tubular member, and the pressing of the master element, flexible sheet material and print receiving member is effected between said tubular member and an impression roller.

3. The method defined by claim 2, wherein the flexible sheet material comprises a length of tape, and the impression roller is intermittently operated to engage and advance the flexible tape in timed relation to the delivery of the master element and print receiving member to the printing zone, and to simultaneously press the master element, flexible tape and print receiving member together.

4. The method defined by claim 3, wherein the indicia of said master element occupies a space of predetermined longitudinal dimension, and the tape is intermittently advanced a distance generally corresponding to the predetermined longitudinal dimension.

5. The method defined by claim 1, wherein the heating element is energized during feeding movement of a master element passed the heating element.

6. The method defined by claim 1, which comprises the further steps of delivering a plurality of master elements and a plurality of print receiving members singly and in succession from separate magazines through the printing zone in timed relation so that each print receiving member registers with a different master element.

7. The method defined by claim 6, wherein the movement of a print receiving member toward the printing zone initiates movement of the master element to the printing zone.

8. The method defined by claim 6, wherein the used master elements and printed members are delivered to separate receivers after passing through the printing zone.

9. The method defined by claim 3, wherein the flexible tape, master element and print receiving member are separated from one another as they move from the printing zone.

10. The method defined by claim 1, wherein the master element, flexible sheet material and print receiving member are pressed together by a pressure roller having a portion movable toward and away from a pressing relationship with said members, and the pressure roller is operated in response to the delivery of a master element and print receiving member to said printing zone.

11. A method of reproducing material imprinted on a plurality of master elements having indicia of heat conducting material thereon onto a like number of print receiving members comprising the steps of:

(a) delivering master elements singly and in succession from a magazine through a printing zone in which a heating element is disposed;

(b) delivering print receiving members singly and in succession from a magazine through the printing zone in respective registration with the master elements, each print receiving member being disposed outwardly of the associated master element relative to the heating element, the movement of a print receiving member toward the printing zone initiating movement of the associated master element to the printing zone;

(c) intermittently advancing a predetermined length of flexible tape provided with a heat transferable printing medium through the printing zone in timed relation to the delivery of an associated master element and print receiving member to the printing zone;

(d) and simultaneously pressing the flexible tape, associated master element and print receiving member together during movement thereof through the printing zone.

12. The method defined by claim 11, wherein the heating element is energized intermittently as a function of movement of an associated master element and print receiving member toward the printing zone.

13. The method defined by claim 11, wherein the flexible tape is supported under predetermined tension.

14. The method defined by claim 13, wherein the tape is intermittently advanced against its supporting tension.

15. The method defined by claim 14, wherein the indicia of each master element occupies a space of predetermined longitudinal dimension, and the tape is intermittently advanced a distance generally corresponding to the predetermined longitudinal dimension.

16. The method defined by claim 11, wherein the used master elements and printed members are delivered to separate receivers after passing through the printing zone.

17. The method defined by claim 11, wherein the flexible tape, master element and print receiving member are separated from one another as they move from the printing zone.

18. The method defined by claim 11, wherein the master element, flexible tape and print receiving member are pressed together by a pressure roller having a portion movable toward and away from a pressing relationship with said members, and the pressure roller is operated in response to the delivery of a master element and print receiving member to said printing zone.

* * * * *

UNITED STATES PATENT AND TRADEMARK OFFICE

CERTIFICATE OF CORRECTION

PATENT NO. : 4,391,194

DATED : July 5, 1983

INVENTOR(S) : Ronald A. Rogers et al

It is certified that error appears in the above—identified patent and that said Letters Patent is hereby corrected as shown below:

Column 1, line 22, "indica" should be --indicia--.

Column 1, line 42, ";" should be --,--.

Column 3, line 37, "ajustment" should be --adjustment--.

Signed and Sealed this

*Eleventh* Day of *October 1983*

[SEAL]

*Attest:*

GERALD J. MOSSINGHOFF

*Attesting Officer*

*Commissioner of Patents and Trademarks*